US007444972B2

(12) United States Patent
Faria et al.

(10) Patent No.: US 7,444,972 B2
(45) Date of Patent: Nov. 4, 2008

(54) LEVER FOR A VALVE CONTROL OF A PISTON MACHINE

(75) Inventors: Christof Faria, Erlangen (DE); Frank Himsel, Obermichelbach (DE)

(73) Assignee: Schaeffler KG, Herzogenaurach (DE)

( * ) Notice: Subject to any disclaimer, the term of this patent is extended or adjusted under 35 U.S.C. 154(b) by 87 days.

(21) Appl. No.: 10/598,793

(22) PCT Filed: Feb. 9, 2005

(86) PCT No.: PCT/EP2005/001273

§ 371 (c)(1),
(2), (4) Date: Sep. 12, 2006

(87) PCT Pub. No.: WO2005/088083

PCT Pub. Date: Sep. 22, 2005

(65) Prior Publication Data

US 2007/0151533 A1 Jul. 5, 2007

(30) Foreign Application Priority Data

Mar. 12, 2004 (DE) ..... 10 2004 012 142

(51) Int. Cl.
*F01L 1/18* (2006.01)

(52) U.S. Cl. ..... 123/90.39; 123/90.41; 74/559

(58) Field of Classification Search ..... 123/90.39, 123/90.41; 29/888.2; 74/559
See application file for complete search history.

(56) References Cited

U.S. PATENT DOCUMENTS

| | | | | |
|---|---|---|---|---|
| 3,194,200 | A | 7/1965 | Brogren | |
| 6,959,676 | B2 * | 11/2005 | Okubo et al. | 123/90.39 |

FOREIGN PATENT DOCUMENTS

| | | |
|---|---|---|
| DE | 19742778 | 4/1999 |
| DE | 10030341 | 1/2002 |
| JP | 11210417 | 8/1999 |
| JP | 11210418 | 8/1999 |
| JP | 2004066259 | 3/2004 |
| WO | 03044330 | 5/2003 |
| WO | 03064821 | 8/2003 |

OTHER PUBLICATIONS

Segeth, Wolfgang: Elementare Logik, 3. unveraenderte Auflage. WEB-Deutscher Verlag der Wissenschaften, Berlin, 1970, S. 74-76.

* cited by examiner

*Primary Examiner*—Zelalem Eshete
(74) *Attorney, Agent, or Firm*—Volpe and Koenig, P.C.

(57) ABSTRACT

A lever for a valve control of a piston engine is provided, which is embodied as a rocker arm, rocker lever or finger lever. A roller (6) is rotationally mounted on a support pin (7) in an intermediate space of the lever. The lateral sides (1, 2) are tapered (8, 9, 10, 16) in a region of a bore (14) which receives the support pin (7), whereby the sum of the widths (12, 13) of the lateral parts (1, 2) is smaller than a total width (11) of the intermediate space (5) enabling a counter perforation of the bore (14) to be possible.

9 Claims, 1 Drawing Sheet

LEVER FOR A VALVE CONTROL OF A PISTON MACHINE

FIELD OF THE INVENTION

The invention relates to a lever for the valve control of a piston engine, preferably for the reciprocating valve control of an internal combustion piston engine, like a rocker arm, rocker lever, or finger lever, with a roller, which is situated in an intermediate space between two side parts of the lever and which is supported on a support pin mounted in the lever.

BACKGROUND OF THE INVENTION

Levers of the type named above are used preferably for reciprocating valve controls of internal combustion piston engines. In the production of such a lever, a bore hole for the installation of the support pin is machined into each side part, so that these bore holes lie coaxial relative to each other. This is typically realized for a (sheet-metal) lever shaped without cutting through counter perforation of the two lever side parts, with the material pieces separated during the perforation first being pressed into the roller pocket between the two side parts and then being removed from there. This method cannot be used when the sum of the thicknesses of the separated material pieces is greater than a width of the roller pocket in the lever.

From the background art, it is known to machine depressions on the outer sides of the side parts in the region of the holes. These depressions are to enable a positive-fit rotational lock for the support pin. According to DE 197 42 778 A1, a related cylindrical depression is already known. According to WO 03/064821 A1, a bezel for holding rotational locking means for the support pin can be set on a lever. However, in both cases, it must be produced during the final processing of the bore hole for the support pin. Producing the depressions during or before the perforation is excluded.

OBJECT OF THE INVENTION

The invention is based on the objective of ensuring counter perforation for producing bore holes in both side parts of the lever even for levers with a roller pocket width that is smaller, due to structural reasons, than the sum of the thicknesses of both side parts.

SUMMARY OF THE INVENTION

The invention is based on the knowledge that the method of counter perforation can be used in such levers under the condition that the sum of the thicknesses of the material pieces separated during perforation is smaller than the width of the roller pocket.

Therefore, the invention starts with a lever for the valve control of a piston engine, like a rocker arm, rocker lever or finger lever, with a roller, which is provided for the support of a rotating cam, which lies in a roller pocket enclosed by a left and a right side part, and which is rotatably mounted on a support pin mounted in the lever.

To meet the stated objective, the wall thickness of the side parts is also reduced in the surrounding area of the later bore hole for holding the support pin. Here, the wall thicknesses should be reduced so much that the width of the roller pocket is greater than or equal to the sum of the locally reduced lever wall thicknesses of the left and the right side part.

Such a tapered section simultaneously reduces the supporting width of the side parts relative to the support pin. Finally, this requires an optimization of the dimensional relationships while simultaneously maintaining the condition according to the invention.

The tapered section of the side parts can be realized through an original forming method, a shaping method, or a material-removing method. It can also advantageously replace the depressions frequently formed at a later time in known levers for fixing the support pin. The shape of the tapered section can be anything as long as the maximum permissible thickness of the lever wall thicknesses is not exceeded in the region of this tapered section.

In addition, it can be provided to machine the mentioned tapered section of the lever side walls with the production of the rough shape of the lever and to generate this tapered section through shaping processes. An additional advantage can emerge in that the base material is fixed through later material shaping.

Likewise, it can be provided to generate the tapered section through material-removing methods.

Furthermore, there is the possibility of arranging the tapered section on the outer sides, the inner sides, or on both sides of the side parts according to production-specific requirements. Thus, for example, a tapered section on the outer side of the left side part can be paired with a tapered section on the inner side of the right side part. Likewise, a tapered section on the inner side of the left side part can be combined with a tapered section on the inner side in the right side part. Further possibilities are available through combining the four possible positions of the tapered sections with each other. The selection of the combinations can follow according to structural requirements, operating conditions resulting from the specific application, or production-specific initial conditions.

A preferred embodiment of the invention is provided by providing each tapered section on the outside which extends into the two side parts. In this way, there is the possibility of fixing each support pin in the region of the support pin, wherein the techniques for connecting the side parts and the support pin can be utilized.

BRIEF DESCRIPTION OF THE DRAWINGS

An embodiment of the invention is shown in the drawing and is described in more detail below. Shown therein are FIG. 1 a perspective view of the lever according to the invention.

DETAILED DESCRIPTION OF THE DRAWINGS

Figure 1:
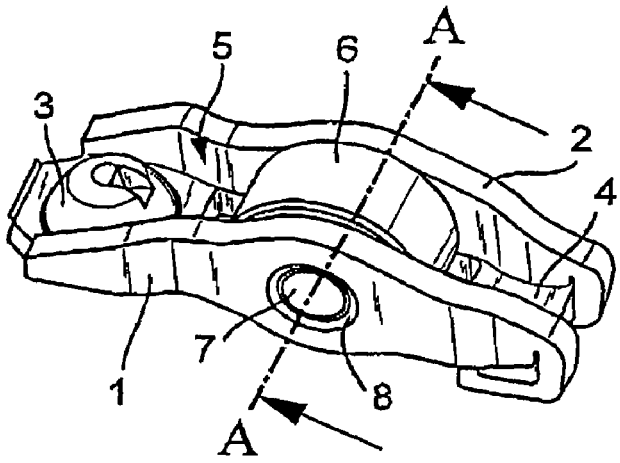

FIG. 1 shows a roller finger lever, as can be used in the reciprocating valve control of internal combustion piston engines. This lever is formed essentially from a left side part 1, a right side part 2, a connecting piece 3 (support ball socket), and a connecting piece 4 (clip). A roller 6, which is mounted rotatably on a support pin 7, is located in the roller pocket 5 between the left side part 1 and the right side part 2. In addition, it can be seen that a tapered section 8 of the side part is formed at least on the outer side of the left side part 1.

Figure 2:
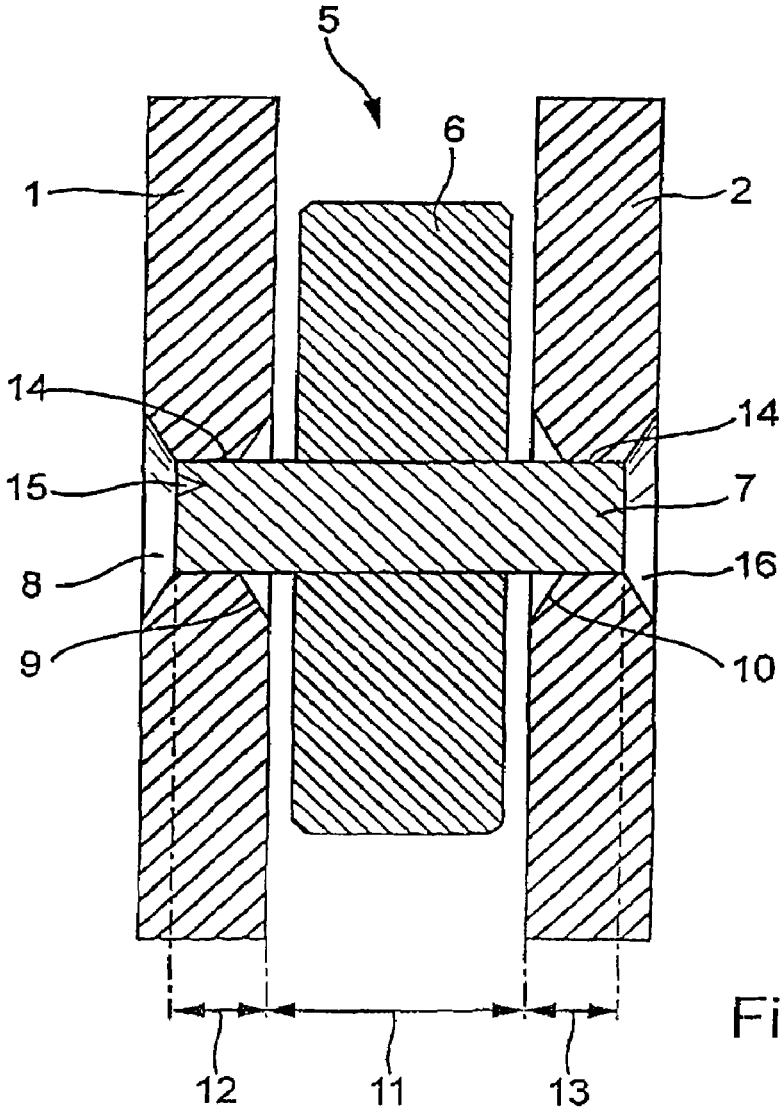
FIG. 2 a sectional view of the lever in the plane of the bearing (section A-A).

As FIG. 2 illustrates, it is possible to form two such tapered sections at each of the two side parts 1, 2, so that a maximum of four tapered sections 8, 9, 10, and 16 can be combined with each other in any combination. In each case, it is ensured that the width 12 supporting the support pin 7 in the left side part 1 as well as the supporting width 13 in the right side part 2 are adapted to each other in terms of their mechanically necessary dimensions.

The tapered sections 8, 9, 10, and 16 are sufficiently deep so that the sum of the supporting width 12 of the left side part 1 and the supporting width 13 of the right side part 2 for the support pin 7 is smaller than or at most equal to the total width 11 of the roller pocket 5. From this fact, it results that the sum of the thicknesses of the material pieces separated during the counter perforation is also smaller than or at most equal to the total width 11 of the roller pocket 5.

Therefore, the preferred method for producing the bore holes 14 for the support pin 7 in the side parts 1, 2 through counter perforation can be kept despite reduction in width of the roller pocket 5.

The construction described above enables the roller pocket 5 to be reduced in its total width 11 as much as structural, technological, and operating-specific requirements allow. Therefore, material use for the lever and for the roller 6, as well as their overall size, can be reduced. Thus, a reduction of the mass to be moved can also be achieved, which opens up possibilities for optimizing the operating behavior of the relevant piston engines. This minimization is limited only by strength requirements.

For the production of a lever exclusively with outer lying tapered sections 8 and 16, there is the possibility of using the existing free space for a locking part 15 for the support pin 7, wherein this can be realized according to known processing methods.

List of Reference Symbols

1 Left side part
2 Right side part
3 Connecting piece (socket)
4 Connecting piece (clip)
5 Roller pocket
6 Roller
7 Support pin
8 Outer lying tapered section in left side part 1
9 Inner lying tapered section in left side part 1
10 Inner lying tapered section in right side part 2
11 Total width of roller pocket 5
12 Supporting width in side part 1
13 Supporting width in side part 2
14 Bore hole
15 Locking part
16 Outer lying tapered section in right side part 2

The invention claimed is:

1. Lever for a valve control of a piston engine, comprising a rocker arm, rocker lever or finger lever, with a roller, which is arranged in a roller pocket formed by a left side part and a right side part of the lever and which is rotatably mounted on a support pin arranged in the lever, a width of the roller pocket is smaller than a sum of total thicknesses of the left side part and the right side part of the lever, wherein the left side part and the right side part are tapered sufficiently via tapered sections in a region of a bore hole for holding the support pin, and a sum of a width of the left side part supporting the support pin and a width of the right side part supporting the support pin is smaller than the width of the roller pocket.

2. Lever according to claim 1, wherein at least one of the tapered sections in the side parts of the lever is generated by shaping processes.

3. Lever according to claim 1, wherein at least one of the tapered sections in the side parts of the lever is generated by removing material.

4. Lever according to claim 1, wherein the tapered sections in the left side part and in the right side part are each arranged on an outside or inside thereof.

5. Lever according to claim 1, wherein the support pin has a locking part in a region of at least one of the outer tapered sections for at least one of rotational or positional locking.

6. Lever according to claim 1, wherein one of the side parts has an outer tapered section, while the tapered section on the other side part faces towards the roller pocket.

7. Lever according to claim 1, wherein of the each side parts has an outer tapered section.

8. Lever according to claim 1, wherein each of the side parts has a tapered section that faces towards the roller pocket.

9. Lever according to claim 1, wherein each of the side parts has an outer tapered section and a tapered section that faces toward the roller pocket.

* * * * *